US008723087B2

(12) United States Patent
Cho

(10) Patent No.: US 8,723,087 B2
(45) Date of Patent: May 13, 2014

(54) METHOD FOR MANUFACTURING PIPE-TYPE WOVEN CARBON FIBERS AND CARBON FIBER HEATING LAMP USING THE PIPE-TYPE WOVEN CARBON FIBERS

(75) Inventor: Jeong-youn Cho, Incheon (KR)

(73) Assignee: LG Electronics Inc., Seoul (KR)

( * ) Notice: Subject to any disclaimer, the term of this patent is extended or adjusted under 35 U.S.C. 154(b) by 883 days.

(21) Appl. No.: 11/886,356

(22) PCT Filed: Dec. 30, 2005

(86) PCT No.: PCT/KR2005/004657
§ 371 (c)(1),
(2), (4) Date: Sep. 14, 2007

(87) PCT Pub. No.: WO2006/098548
PCT Pub. Date: Sep. 21, 2006

(65) Prior Publication Data

US 2008/0185375 A1 Aug. 7, 2008

(30) Foreign Application Priority Data

Mar. 17, 2005 (KR) ..... 20-2005-0007228 U
Aug. 18, 2005 (KR) ..... 10-2005-0075605

(51) Int. Cl.
*H05B 3/10* (2006.01)
*B28B 1/00* (2006.01)
*A45D 20/40* (2006.01)

(52) U.S. Cl.
USPC ..... 219/553; 264/632; 392/407; 392/497

(58) Field of Classification Search
USPC ..... 219/553; 392/497
See application file for complete search history.

(56) References Cited

U.S. PATENT DOCUMENTS

| | | | | |
|---|---|---|---|---|
| 4,069,410 | A * | 1/1978 | Keep, Jr. | 219/535 |
| 4,100,673 | A * | 7/1978 | Leavines | 29/611 |
| 4,825,049 | A * | 4/1989 | Rickborn | 219/545 |
| 5,665,262 | A * | 9/1997 | Hajaligol et al. | 219/553 |
| 6,501,056 | B1 * | 12/2002 | Hirohata et al. | 219/553 |
| 6,584,279 | B2 * | 6/2003 | Seko et al. | 392/407 |
| 6,949,727 | B2 * | 9/2005 | Park | 219/548 |

FOREIGN PATENT DOCUMENTS

| | | | |
|---|---|---|---|
| JP | 08-031551 | A | 2/1996 |
| JP | 2001-332373 | A | 11/2001 |
| JP | 2004-335350 | A | 11/2004 |

OTHER PUBLICATIONS

Japanese Office Action dated Jun. 6, 2011 issued in Application No. 2008-501796.

* cited by examiner

*Primary Examiner* — Dana Ross
*Assistant Examiner* — Ket D Dang
(74) *Attorney, Agent, or Firm* — Ked & Associates LLP

(57) ABSTRACT

A method of manufacturing a carbon-fiber pipe which is hollow and has a net shape, by knitting carbon fibers and general fibers, applying carbon or ceramic, and heating to burn the general fibers, and a carbon fiber heating lamp using the carbon-fiber pipe are provided. The carbon fiber heating lamp includes a vacuum glass tube, a tubular carbon fiber pipe, which is knitted using carbon fiber and general fiber as a raw material and has a hollow part, and a heating element. The heating element includes the tubular carbon fiber pipe which has a predetermined length and is installed in the vacuum glass tube, and generates heat using power supplied from an exterior through both terminals provided on an outer portion of the vacuum glass tube.

7 Claims, 5 Drawing Sheets

METHOD FOR MANUFACTURING PIPE-TYPE WOVEN CARBON FIBERS AND CARBON FIBER HEATING LAMP USING THE PIPE-TYPE WOVEN CARBON FIBERS

TECHNICAL FIELD

The present invention relates, in general, to a carbon fiber heating lamp and a method of manufacturing a carbon-fiber pipe therefor and, more particularly, to a method of manufacturing a carbon-fiber pipe which is hollow and has a net shape, by knitting carbon fibers and general fibers as raw materials, applying carbon or ceramic, and heating to burn the general fibers, and a carbon fiber heating lamp using the carbon-fiber pipe.

BACKGROUND ART

Generally, lamps include a vacuum glass tube and a filament installed in the glass tube. The lamps are typically classified into illumination lamps, which generate light when current flows in the filament, and heating lamps which generate heat in the filament. Such a lamp is manufactured by installing a filament in a vacuum glass tube and installing terminals on the opposite ends of the glass tube to connect the filament to the outside. In a detailed description, the lamp is manufactured by installing the tungsten filament in the glass tube along the axis thereof, injecting iodine gas in the glass tube, and sealing the glass tube. When electric current flows into (electricity is applied to) the filament of the lamp manufactured in this way, tungsten atoms present in the filament combine with iodine on the wall of the glass tube, thus being converted into tungsten iodide. Thereafter, the compound returns to the filament. The tungsten iodide returning to the filament is decomposed, so that tungsten remains in the filament. Such a process is called an iodine cycle. The lamp undergoing the iodine cycle can be used very efficiently for a lengthy period of time.

However, the conventional lamp operated as described above is problematic in that the filament may be easily damaged by external impacts, and the filament may be easily deformed due to generated heat. That is, the lamp is not durable. Further, the conventional lamp is problematic in that a high cost is required to install the filament, so that the lamp is expensive.

Meanwhile, carbon fibers used in a sheet-type heating element or the like form a bundle consisting of very fine carbon fibers. For example, assuming that 26,400 carbon fibers are prepared and each carbon fiber is 1 m in length and 0.3 mm in diameter, the bundle of carbon fibers has the resistance value of about 60Ω. Thus, the desired power (watt) is designed based on such a principle, thereby the sheet-type heating element is manufactured. In this case, the resistance value is determined according to the resistance equation: R=rho (l/s). In the equation, R denotes resistance, p denotes resistivity, l denotes length, and s denotes a unit area. However, the carbon fibers are used as a heating source of the sheet-type heating element, which is designed to generate a temperature ranging from about 50° C. to about 70° C. If the temperature exceeds 70° C., there is a danger of fire, and the sheet-type heating element may be oxidized by oxygen, so that the durability of the sheet-type heating element will be remarkably reduced.

Meanwhile, a heating lamp has been proposed, which uses the carbon fiber as a heating source and installs the carbon fiber in a vacuum tube. However, the technology of forming a certain bundle of carbon fibers to determine the resistance value and thus provide a desired power, the technology of securing carbon fibers to terminals, and the technology of bundling carbon fibers are below a desired level. Thereby, it is difficult to industrialize the heating lamp. As one example of the technology, a carbon-based heating element has been proposed, which is disclosed in Japanese Patent Laid-Open Publication No. 2000-123960. According to the cited document, as shown in FIG. 1, cap-shaped electrode parts 2 are provided on the opposite ends of a carbon-based heating element 1. The carbon-based heating element 1 and the cap-shaped electrode parts 2 are installed in a vacuum hermetic tube 3. The cap-shaped electrode parts 2 are connected to lead wires 4 for applying electricity. As shown in FIG. 2, each lead wire 4 is secured to a carbon core 5, which is formed by binding the outer circumference of a bundle of carbon fibers 6 with carbon yarns 7.

The heating element 1 comprises at least one carbon core 5, and the cap-shaped electrode parts 2 are mounted to the opposite ends of the heating element 1. The components combined in this way are housed in the vacuum hermetic tube 3.

In such a heating element, a desired carbon fiber 6 is selected and a desired number of carbon fiber bundles is used to provide a desired resistance value and thus output a desired power W. However, the heating element is problematic in that it is complicated to bind the carbon fibers 6 with the carbon yarns 7, and the carbon core must be impregnated into liquid resin to prevent the tied carbon yarns 7 from being removed, as necessary.

Meanwhile, in order to increase the power, a method of increasing the length of carbon fibers has been proposed, in place of increasing the number of carbon fibers. This is disclosed in Japanese Patent Laid-Open Publication No. 2002-63870 (US Patent Laid-Open Publication No. 2001/0055478A1), and is illustrated in FIG. 3. As shown in the drawing, lead wires 4 are provided on the opposite ends of a vacuum hermetic tube 3, and electrode pieces 4-1 connected to the lead wires 4 in such a way as to conduct electricity are seated on plane terminal parts 3-1 which press and support the opposite ends of the vacuum hermetic tube 3. Further, spacers 13 are installed at regular intervals so as to support a coil band-type carbon-fiber filament 10 on the inner wall of the vacuum hermetic tube 3. Support terminals 20 each having a power applying sleeve 20-1 are installed on the opposite ends of the carbon-fiber filament 10. Each of the support terminals 20 includes the sleeve 20-1, and a connecting piece 20-2 which is integrated with the sleeve 20-1 and is connected to an intermediate terminal 20-3.

However, such a technology functions to simply secure the carbon-fiber filament 10 to the intermediate terminals 20. The technology is problematic in that it is difficult to locate the filament 10 at a central position in the vacuum hermetic tube 3, so that the spacers 13 must also be installed. Further, the carbon-fiber filament 10 has a structure obtained by arranging the bundle of carbon fibers to a predetermined width and forming the bundle in a band shape. Thus, the coupling force between the carbon fibers is weak, so the carbon fibers constituting the carbon fiber bundle may be separated from each other by impact or after use for a lengthy period of time, and thereby durability may be reduced.

Meanwhile, an example of a heating lamp, which uses a carbon fiber strand obtained by twisting carbon fibers in the form of a band, as a heating element, is disclosed in U.S. Pat. No. 6,534,904. As shown in FIG. 4, the heating lamp is constructed so that a heating element **2*a* which is wound spirally and has the shape of a carbon ribbon is accommodated in a vacuum hermetic tube 3, and external electricity is supplied through support terminals 20 and connectors la to the opposite ends of the heating element 2***a*. In this case, the heating element 2*a* is constructed to have a length which is 1.5 times as long as the length B of the vacuum hermetic tube, thus providing a desired power. That is, the heating element 2*a* has a spiral shape such that the heating element extends to a predetermined length to have a desired resistance value. However, such a technology is problematic in that there is no component for supporting the heating element 2*a*, so that the heating element 2*a* may sag and come into contact with the inner wall of the hermetic tube 3. Due to such contact, overheating occurs, so durability is reduced, and thereby it is difficult to industrialize the heating lamp.

An apparatus for manufacturing a carbon-ribbon-type heating element was proposed in U.S. Pat. No. 6,464,918. Referring to FIG. 5, the apparatus includes a spiral shaft 4*b*, a feeding means 10*b*, a motor 12*b*, a hot air fan 5*b*, a nozzle 6*b*, and a drive motor 11*b*. The spiral shaft 4*b* has the same diameter as the heating element to be wound. The feeding means 10*b* feeds a carbon ribbon 3*b* into the spiral shaft 4*b* . The motor 12*b* provides a driving force to the feeding means 10*b*. The hot air fan 5*b* heats the carbon ribbon 3*b* which is fed through the feeding means 10*b*. The nozzle 6*b* discharges hot air through the hot air fan 5*b* to the carbon ribbon 3*b*. The drive motor 11*b*, coupled to the hot air fan 5*b*, moves the hot air fan 5*b* along a rail 7*b* in the direction of arrow 9*b*. In this case, the rail 7*b* is installed to be parallel to the spiral shaft 4*b*. Reference numeral 13*b* denotes a control line or an actuating means which drive the motors 11*b* and 12*b* simultaneously. Further, it is desirable that the carbon ribbon 3*b* have a tension force 8*b* so that the carbon ribbon 3*b* is wound around the spiral shaft 4*b* in a constant fashion. Subsequently, hot air of about 300° C. is supplied from the hot air fan 5*b* to soften the carbon ribbon. The feeding means 10*b* feeds the carbon ribbon 3*b* at the same speed as the moving speed of the hot air fan 5*b*, so that the carbon ribbon 3*b* spirally wound around the spiral shaft 4*b* is softened. When the carbon ribbon has been wound, it is heated at about 1000° C. in pressure of nitrogen gas, and thereafter is cooled, so that the simple carbon ribbon has a spiral shape, and thereby the heating element of FIG. 4 is obtained. Such a process changes the properties of the simply wound carbon ribbon to a spiral structure having a restoring force. That is, resin in the heating element comprising carbon fiber/resin constituting the carbon ribbon is evaporated at high heat (1000° C.), so that the heating element contains only carbon. Thereby, the properties of the heating element are changed to be hard (but the heating element is thin, and so has elastic force). Consequently, the spiral heating element is obtained.

However, such a heating element is based on a band-shaped heating element, so that it is limitedly able to maintain its elastic force, and it is difficult to produce the heating element as a product. Further, as shown in FIG. 3, the spacers must be installed at regular intervals, so that marketability is poor.

DISCLOSURE OF THE INVENTION

Technical Problem

Accordingly, the present invention has been made keeping in mind the above problems occurring in the prior art, and an object of the present invention is to provide a method of manufacturing a carbon fiber pipe and a carbon fiber heating lamp using the carbon fiber pipe, in which a heating element is knitted to have the shape of a braid using carbon fibers and general fibers, and has the shape of a tube that is hollow in a central portion thereof, so that it is easy to manufacture, and a desired resistance value is achieved using the heating element having a relatively short length, and the carbon fiber pipe has various capacitances.

Another object of the present invention is to provide a method of manufacturing a carbon fiber pipe and a carbon fiber heating lamp using the carbon fiber pipe, in which a tubular heating element is used, thus allowing air to circulate in hollow internal space, and allowing the internal space to accommodate the deformation, therefore easily maintaining external appearance.

A further object of the present invention is to provide a method of manufacturing a carbon fiber pipe and a carbon fiber heating lamp using the carbon fiber pipe, in which carbon fibers are knitted in the form of a unit strand, thus allowing the magnitude of a resistance value to be easily adjusted.

Yet another object of the present invention is to provide a method of manufacturing a carbon fiber pipe and a carbon fiber heating lamp using the carbon fiber pipe, in which a heating element is made in the form of a cylindrical carbon fiber pipe, thus easily adjusting the diameter of the pipe by replacing the head of a knitting machine with another one during a knitting operation, therefore easily adjusting the resistance value of the heating element by adjusting the diameter thereof.

A still further object of the present invention is to provide a method of manufacturing a carbon fiber pipe and a carbon fiber heating lamp using the carbon fiber pipe, in which carbon fibers are stranded in the form of a braid and thereafter forms, as a heating element, a carbon fiber pipe that is hollow in a central portion in a longitudinal direction thereof and has the form of a knit fabric.

Technical Solution

In order to accomplish the objects, the present invention provides a carbon fiber heating lamp, including a vacuum glass tube, a tubular carbon fiber pipe (30) knitted using carbon fiber (6) and general fiber as a raw material and having a hollow part, and a heating element comprising the hollow tubular carbon fiber pipe (30) which has a predetermined length and is installed in the vacuum glass tube, and generating heat using power supplied from an exterior through both terminals provided on an outer portion of the vacuum glass tube.

Preferably, a surface of the carbon fiber pipe (30) is coated, thus providing a coating layer (40) to hold the knitted carbon fiber. In this case, the coating layer (40) is a carbon coating layer or a ceramic coating layer.

Preferably, the carbon fiber (6) comprises a unit carbon fiber strand.

Further, the present invention provides a method of manufacturing a carbon fiber pipe for carbon fiber heating lamps, including the steps of forming a hollow tubular carbon fiber pipe by knitting using carbon fiber and general fiber as a raw material; coating and drying a heat-resistant coating layer on a surface of the tubular carbon fiber pipe; and changing the tubular carbon fiber pipe to a net-shaped carbon fiber pipe, by heating the coated carbon fiber pipe and burning only the general fiber.

Preferably, the coated carbon fiber pipe is heated to temperature ranging from 1000° C. to 3500° C.

Advantageous Effects

As described above, according to the present invention, a carbon fiber pipe is woven to have a hollow part in a central position. In this way, the hollow part functions to absorb shocks and resist deformation. Thus, a heating lamp using the carbon fiber pipe has high durability. Further, a large quantity of carbon fibers or carbon cores is woven to have a circular shape. As such, since a large quantity of carbon fibers is used, it is easy to adjust the resistance value. Meanwhile, the prior art is problematic in that it has tended to increase the number of carbon fiber bundles, so that it is not easy to weave, and carbon fiber bundles are easily separated from each other, thus the defect rate is high. Conversely, according to this invention, the carbon fiber pipe is manufactured to have the shape of a cylinder which is hollow, so that it is easy to manufacture, and the same effect when extending the length of carbon fiber is achieved. Thus, even if carbon fiber is short, it has a high resistance value, thus allowing a heating lamp having high power to be manufactured. Further, even though carbon fiber is short, a high resistance value may be obtained merely by increasing the diameter of the carbon fiber pipe. Therefore, various designs of heating lamps may be manufactured.

Moreover, when heat is emitted through the hollow part, the inner and outer surfaces of the carbon fiber pipe maintain a constant temperature, thus preventing deformation, therefore enhancing durability.

Further, according to the invention, the carbon fiber pipe is knitted using carbon fibers alternated with general fibers, and heat-resistance coating is applied to the knitted carbon fiber pipe. Afterwards, when a burning process is executed, the general fibers burned out, and a coating layer is sintered on the surface of the carbon fibers, thus maintaining a shape and having a restoring force. Thereby, when the heating lamp is in use, the durability of the heating lamp is increased.

MODE FOR THE INVENTION

Hereinafter, the preferred embodiments of the present invention will be described in detail with reference to the accompanying drawings.

Figure 6:
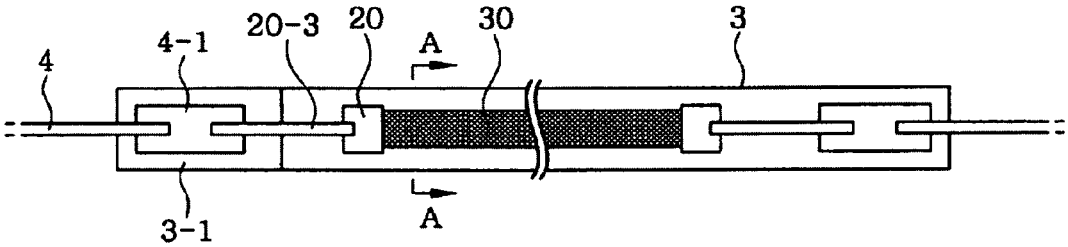
FIG. 6 is a plan view showing a carbon fiber heating lamp, according to the present invention.
Figure 7:
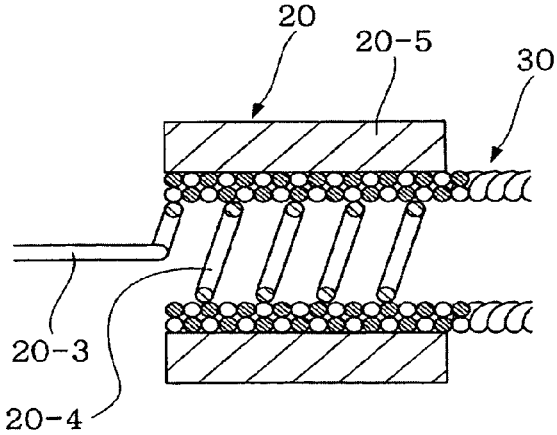
FIG. 7 is a sectional view showing a support terminal of the present invention.
Figure 8:
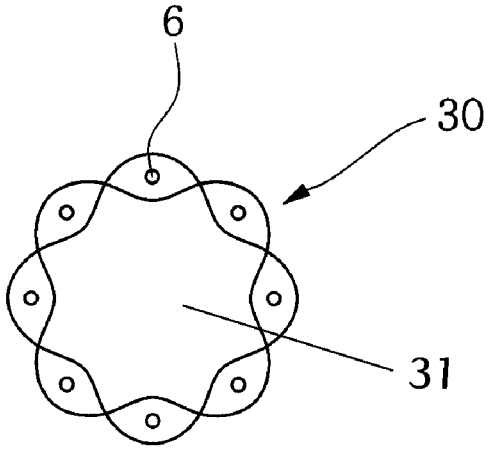
FIG. 8 is an enlarged sectional view taken along line A-A of FIG. 6.
Figure 9:
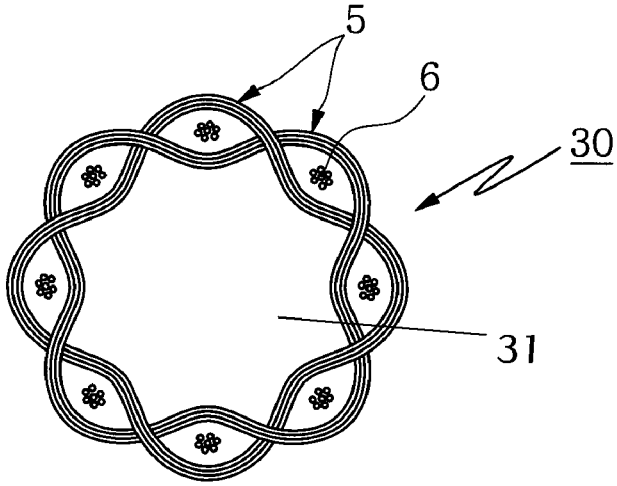
FIG. 9 is an enlarged sectional view showing the use of a strand of carbon fibers.

FIG. 6 is a plan view of the present invention, FIG. 7 is a sectional view of a support terminal, FIG. 8 is an enlarged sectional view taken along line A-A of FIG. 6, and FIG. 9 is an enlarged sectional view showing another example of FIG. 6. A heating element comprises a carbon fiber pipe 30 which has a cylindrical shape formed by twisting several strands of carbon fibers. Support terminals 20 for conducting electricity are provided on the opposite ends of the carbon fiber pipe 30. Each support terminal 20 is secured via a heat-resistant intermediate terminal 20-3 to a corresponding electrode piece 4-1 which is secured to an outer lead wire 4 in such a way to conduct electricity. In this case, each of the intermediate terminal 20-3 and electrode piece 4-1 may be preferably made of molybdenum having superior heat resistance.

Reference numeral 3-1 denotes a plane terminal part on which the corresponding electrode piece 4-1 is seated. One example of the support terminals 20 is shown in FIG. 7. That is, the outer circumference of an end of the carbon fiber pipe 30 is placed on the inner circumference of a corresponding support carbon ring 20-5. Further, a coupling spring 20-4 is fitted into the corresponding support carbon ring 20-5, because the coupling spring is biased outwards. The intermediate terminal 20-3 is integrated with the outer end of the coupling spring 20-4.

FIG. 8 is a sectional view taken along line A-A of FIG. 6, illustrating the cylindrical carbon fiber pipe 30 which is woven using the carbon fibers 6, in the manner of making a braid. Of course, the carbon fiber pipe may be woven such that the diameter thereof is appropriately adjusted by adjusting the size and interval of weaving needles. Reference numeral 31 denotes a hollow part of the carbon fiber pipe 30.

FIG. 9 is a view illustrating another carbon fiber pipe 30 woven based on the method of FIG. 8, in which the carbon fiber pipe is woven not using a unit carbon fiber 6 but using a carbon strand 5.

As the example of a knitting machine which may be used in the present invention, there are Korea U.M. Publication No. 1994-8522 titled "Knitting machine for manufacturing braids", Korea U.M. Publication No. 1994-8523 titled "Braiding machine", Korea U.M. Registration No. 20-0194506 titled "Super-fine yarn for knitting". Since the knitting machine is already known to those skilled in the art, a description of knitting technology and construction will be omitted.

Figure 1:
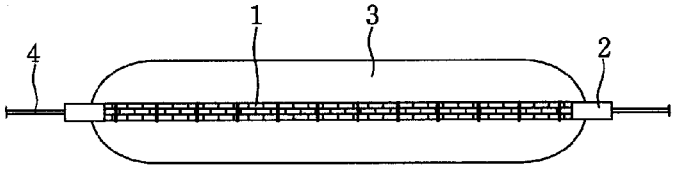
FIG. 1 is a view showing the construction of a conventional carbon-based heating element.
Figure 2:
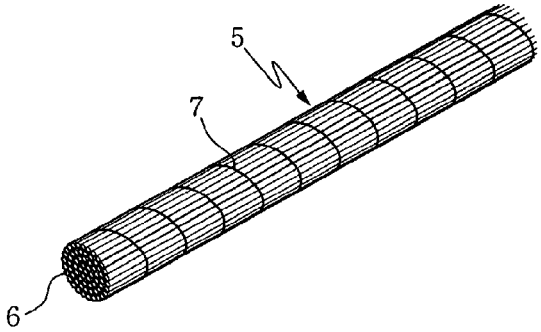
FIG. 2 is an enlarged view showing important parts of the heating element used in FIG. 1.
Figure 3:
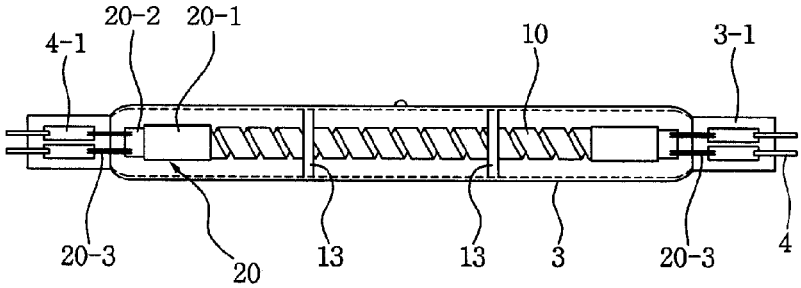
FIG. 3 is a plan view showing a conventional spring-type carbon fiber heating lamp.
Figure 4:
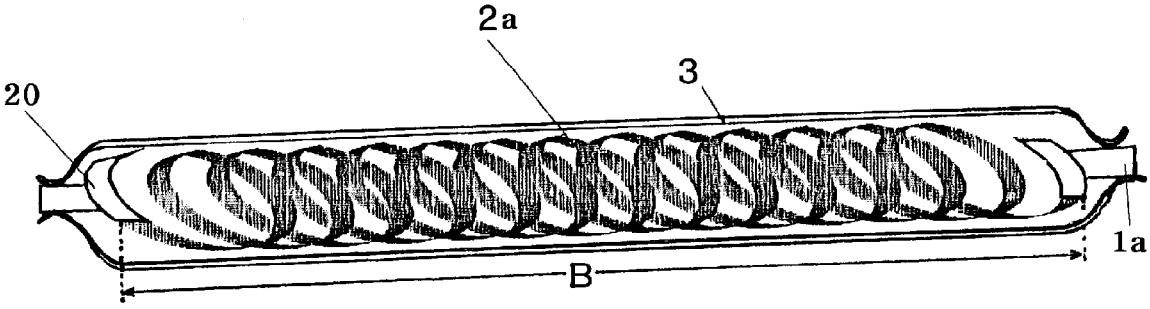
FIG. 4 is a view showing another conventional spring-type carbon fiber heating lamp.
Figure 5:
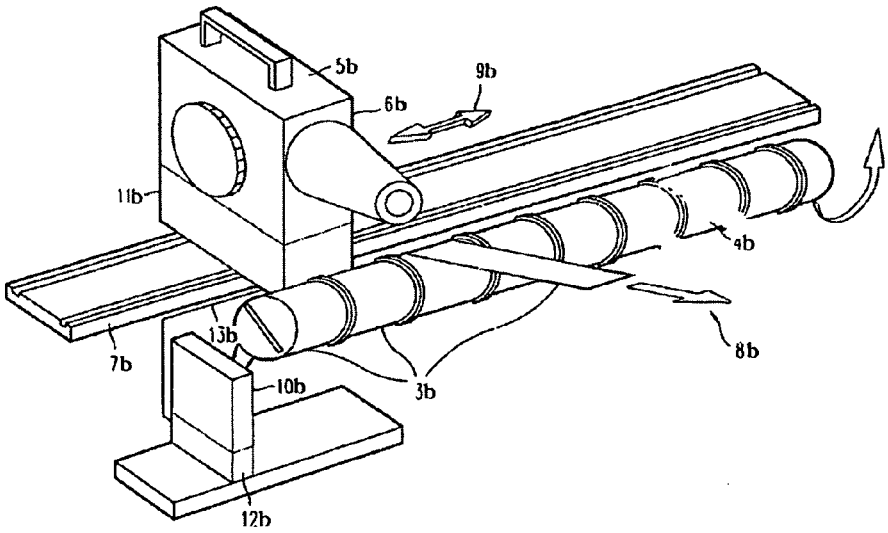
FIG. 5 is a perspective view illustrating an apparatus for manufacturing a carbon fiber heating element of FIG. 4.

Using the carbon fiber pipe 30 woven in this way, a heating lamp is manufactured and used as shown in FIG. 5. In this case, the heating lamp is manufactured through a general manufacturing technology, so that the description of the manufacturing technology will be omitted, and the description will concentrate on the carbon fiber pipe 30.

According to the present invention, as shown in FIGS. 8 and 9, the carbon fiber pipe 30 is woven in the shape of a tubular braid using the carbon fibers 6 or the carbon strand 5. The carbon fiber pipe 30 is woven such that it does not have the shape of a simple braid, but has a hollow part 31 in a central position. Thus, the hollow part 31 functions to absorb shocks and resist deformation to some extent. Therefore, the heating lamp manufactured using such a carbon fiber pipe is highly durable. Since a large quantity of carbon fibers 6 or carbon strands 5 is woven to form a circular shape, it is easy to adjust the resistance value using the large quantity of carbon fibers. In the past, the number of the carbon fiber bundles tended to increase. Hence, it was not easy to weave, and the carbon fiber bundles could undesirably separate from each other, so that a defect rate was high. However, according to this invention, the carbon fiber pipe is manufactured to have the hollow part and the cylindrical shape. Thus, it is easy to manufacture the carbon fiber pipe, and the invention has the effect of naturally extending the length of the carbon fiber. Thereby, even if the carbon fiber is short in length, a high resistance value is achieved, so it is possible to manufacture a heating lamp having high power. Further, although the carbon fiber is short, a high resistance value may be obtained merely by increasing the diameter of the carbon fiber pipe 30. Therefore, various designs of heating lamps can be achieved.

Further, when heat is emitted through the hollow part 31, the inner and outer surfaces of the carbon fiber pipe 30 maintain constant temperature, thus preventing the deformation of the carbon fiber pipe, therefore increasing durability.

A tubular carbon fiber pipe is shown in FIGS. 10 to 13, as another example of the present invention.

The process of manufacturing (knitting) and coating the carbon fiber pipe will be described below.

Figure 10:
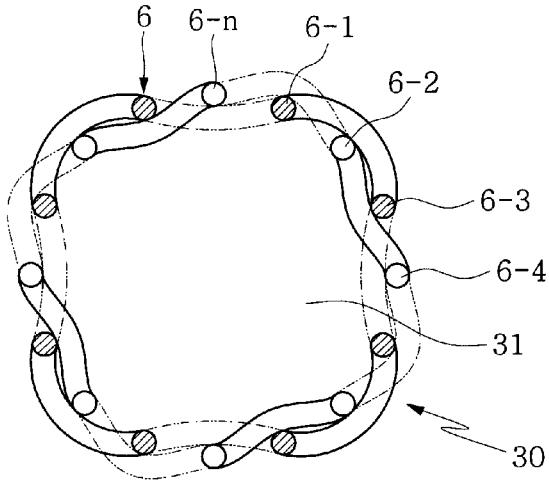
FIG. 10 is a view illustrating the section of FIG. 8 in more detail.
Figure 11:
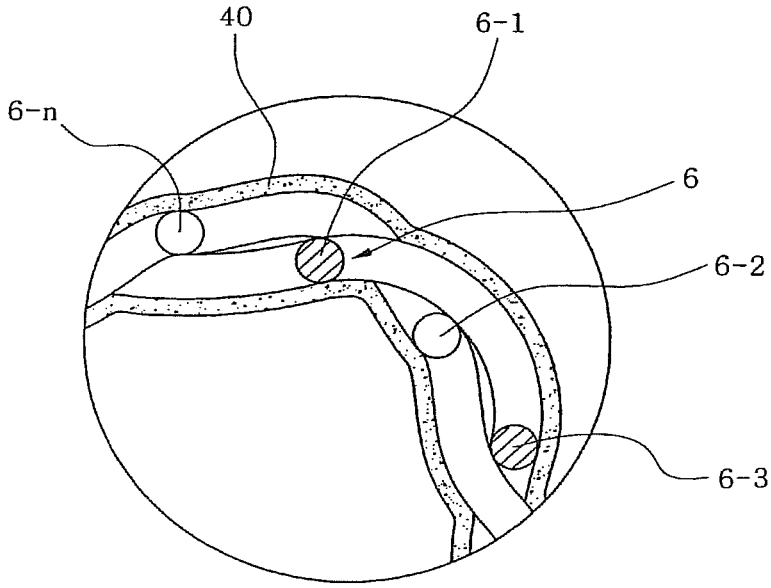
FIG. 11 is a partial sectional view showing the state where a carbon fiber pipe of FIG. 10 is coated.

That is, carbon fibers (e.g. carbon fibers 6-1, 6-3, . . . 6-n-1) and chemical (or cotton) fibers 6-2, 6-4, . . . 6-n are alternately woven. The surface of the woven carbon fiber pipe is coated to form a heat-resistant coating layer 40, which is not shown in FIGS. 10 and 12, but is shown in the enlarged view of FIG. 11 (The coating method may use a spraying method or a dipping method). In this case, a ceramic layer or a carbon coating layer may be used as the coating layer 40. The ceramic layer is formed through the following process. That is, ceramic powder is diluted and is applied to the surface of the knitted carbon fiber pipe 30 in the form of a glaze, and thereafter, is dried to form the coating layer 40 on the surface of each carbon fiber 6, as shown in FIG. 10. Subsequently, the coating layer is sintered on the surface of each carbon fiber 6 through a burning process that will be described later. In this case, the ceramic layer may be made of ceramic ($Al_2O_3$+$ZrO_2$+$Y_2O_3$). Meanwhile, the invention may use carbon coating, for example, a carbon coating composite which is used in a sheet-type heating element or the like and is produced by a Japanese etec company and has the product name, 'carbon block'.

Burning Process

Figure 12:
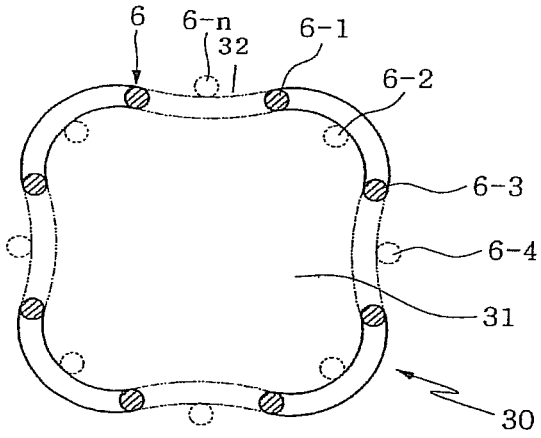
FIG. 12 is a sectional view showing the case where the carbon fiber pipe of FIG. 10 is heated and general fibers are burned.
Figure 13:
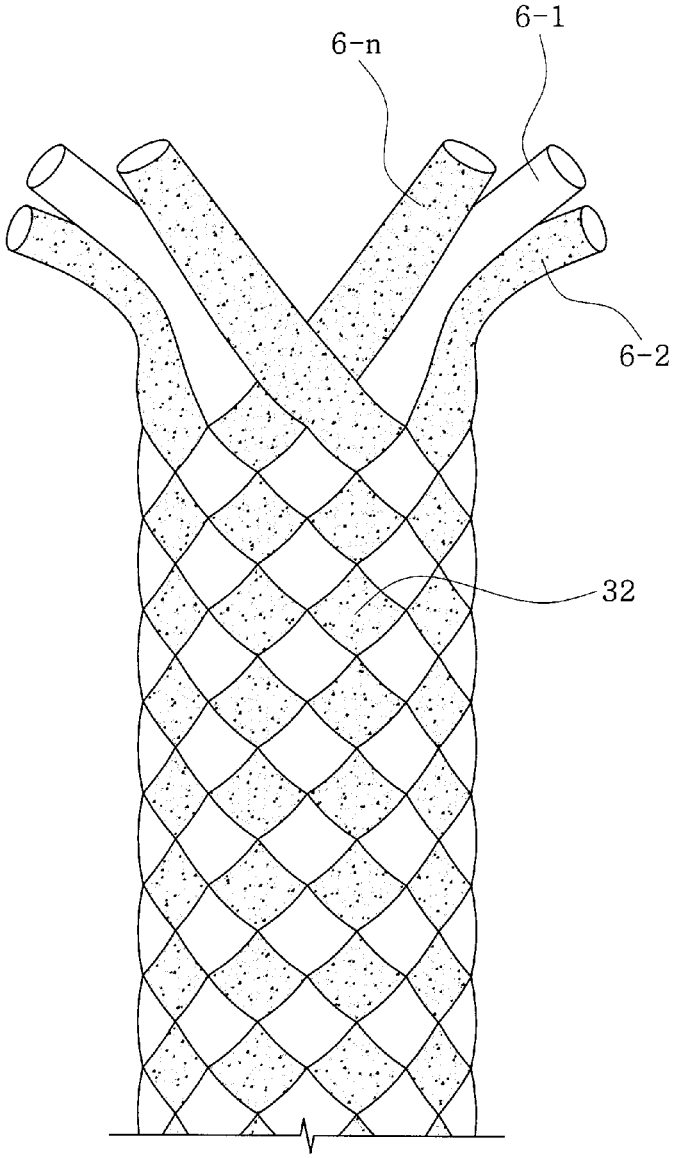
FIG. 13 is a plan view showing the state of reducing the number of carbon fibers and omitting a coating layer, like the tubular carbon fiber pipe of FIGS. 8 to 10 and FIG. 12.

When the knitted and coated carbon fiber pipe is burned at a temperature from 1000° C. to 3500° C., the coating layer 40 is sintered. The general fibers 6-2, 6-4, ... 6-n shown in FIG. 10 are burned, and are formed to have net holes 32, as shown in FIGS. 12 and 13 (the drawing shows the general fibers as being present, but the general fibers are burned out to form the net holes 32 during the burning process). The net holes 32 formed while the general fibers are burned function to couple contact parts of carbon fibers 6-1, 6-3, ... 6-n-1 which remain after the coating layer 40 has been sintered. Thereafter, when a cooling operation (a slow cooling operation or rapid cooling operation may be selected and used) is performed, a carbon fiber pipe having regular net holes 32 is obtained.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An electrical resistance carbon fiber heating lamp, comprising:

a vacuum glass tube;

a plurality of terminals provided in the vacuum glass tube that supplies electrical power from outside the vacuum glass tube; and a carbon fiber heating element provided in the vacuum glass tube connected to the plurality of terminals that receives electrical power from the plurality of terminals and made by a process comprising:

knitting a singular tubular member by intermeshing a plurality of carbon fibers and a plurality of general fibers in turn into the singular tubular member, wherein the singular tubular member comprises a plurality of first carbon fibers, a plurality of first general fibers, a plurality of second carbon fibers that extends perpendicular to the plurality of first carbon fibers and the plurality first general fibers, and a plurality of second general fibers that extends perpendicular to the plurality of first carbon fibers and the plurality of first general fibers; and burning away only the plurality of first general fibers and the plurality of second general fibers of the knitted singular tubular member to make the singular tubular member a tubular netting of the plurality of first carbon fibers and the plurality of second carbon fibers to form the carbon fiber heating element, wherein the singular tubular member further includes a plurality of holes made by the burning away of the plurality of first general fibers and the plurality of second general fibers of the knitted singular tubular member, wherein the plurality of first carbon fibers and the plurality of second carbon fibers are coupled by burning the plurality of first general fibers and the plurality of second general fibers, and wherein the intermeshed shape of the plurality of first carbon fibers and the plurality of second carbon fibers is maintained after the burning away of the plurality of first general fibers and the plurality of second general fibers of the knitted singular tubular member.

2. The electrical resistance carbon fiber heating lamp according to claim 1, wherein the process of making the carbon fiber heating element further includes:

coating a surface of the singular tubular member with a coating layer before burning that holds the knitted plurality of carbon fibers in the tubular netting shape after burning.

3. The electrical resistance carbon fiber heating lamp according to claim 2, wherein the coating layer is a carbon coating layer.

4. The electrical resistance carbon fiber heating lamp according to claim 2, wherein the coating layer is a ceramic coating layer.

5. The electrical resistance carbon fiber heating lamp according to claim 1, wherein the plurality of carbon fibers comprises a unit carbon fiber strand.

6. A method of manufacturing an electrical resistance carbon fiber heating element for carbon fiber heating lamps, the method comprising:

knitting a hollow singular tubular carbon fiber pipe by intermeshing using a plurality of carbon fibers and a plurality of general fibers as raw material, wherein the hollow singular tubular carbon fiber pipe comprises a plurality of first carbon fibers, a plurality of first general fibers, a plurality of second carbon fibers that extends perpendicular to the plurality of first carbon fibers and the plurality first general fibers, and a plurality of second general fibers that extends perpendicular to the plurality of first carbon fibers and the plurality of first general fibers;

coating and drying a heat-resistant coating layer on a surface of the singular tubular carbon fiber pipe; and burning away only the plurality of first general fibers and the plurality of second general fibers of the knitted singular tubular carbon fiber pipe to create a tubular carbon fiber netting to form the electrical resistance carbon fiber heating element, wherein the singular tubular carbon fiber pipe includes a plurality of holes made by the burning of the plurality of first general fibers and the plurality of second general fibers of the knitted hollow singular tubular carbon fiber pipe, wherein the plurality of first carbon fibers and the plurality of second carbon fibers are coupled by burning the plurality of first general fibers and the plurality of second general fibers, and wherein the intermeshed shape of the plurality of first carbon fibers and the plurality of second carbon fibers is maintained after the burning away of the plurality of first general fibers and the plurality of second general fibers of the knitted singular tubular carbon fiber pipe.

7. The method according to claim 6, wherein the burning away includes heating the knitted singular tubular carbon fiber pipe to a temperature ranging from 1000° C. to 3500° C.

* * * * *